United States Patent [19]

Ohm et al.

[11] Patent Number: 4,901,871

[45] Date of Patent: Feb. 20, 1990

[54] DRYING RACK

[75] Inventors: Heinz J. Ohm, Limburg; Peter Tiwi, Nassau, both of Fed. Rep. of Germany

[73] Assignee: Leifheit, Nassau, Fed. Rep. of Germany

[21] Appl. No.: 276,365

[22] Filed: Nov. 23, 1988

[30] Foreign Application Priority Data

Nov. 24, 1987 [EP] European Pat. Off. ..... 87117264.9

[51] Int. Cl.[4] ..... A47F 5/00

[52] U.S. Cl. ..... 211/86; 211/105.1

[58] Field of Search ..... 211/86, 87, 105.1, 105.3, 211/119.01, 123, 175, 208, 88; 248/297.3, 188.5, 214, 297.5, 298, 294; 24/585, 615, 616

[56] References Cited

U.S. PATENT DOCUMENTS

| | | | |
|---|---|---|---|
| 1,903,262 | 3/1933 | Goings | 211/86 X |
| 2,569,622 | 10/1951 | Trainor | 248/297.2 X |
| 3,145,965 | 8/1965 | Stein | 248/188.5 X |
| 3,456,662 | 7/1969 | Weber | 248/188.5 X |
| 3,833,127 | 9/1974 | Schoen et al. . | |
| 4,174,900 | 11/1979 | Ina | 248/188.5 X |
| 4,639,039 | 1/1987 | Donovan | 248/297.3 X |
| 4,786,081 | 11/1988 | Schmidt | 248/297.3 X |

FOREIGN PATENT DOCUMENTS

| | | | |
|---|---|---|---|
| 600995 | 8/1934 | Fed. Rep. of Germany . | |
| 8115237 | 2/1983 | France . | |
| 309157 | 8/1955 | Switzerland . | |
| 525323 | 8/1972 | Switzerland . | |
| 556936 | 12/1974 | Switzerland . | |
| 378046 | 8/1932 | United Kingdom | 211/86 |
| 870294 | 6/1961 | United Kingdom | 211/86 |

*Primary Examiner*—Alvin C. Chin-Shue
*Assistant Examiner*—Sarah A. Lechok
*Attorney, Agent, or Firm*—Frishauf, Holtz, Goodman & Woodward

[57] ABSTRACT

A dryer for laundry, is adapted to be clamped onto stationary objects, and has hanging bars for the laundry, which bars are arranged between two carriers. An adjustable mounting strap or bar, slidably movable in each carrier, is bent at one end to form a hanging hook, and is bent at its other end into a springy tongue. At least one part of the tongue, in combination with a catch, engages into openings in the carriers which are provided for engaging the catch to lock the carriers relative to the slidable mounting straps or bars.

10 Claims, 4 Drawing Sheets

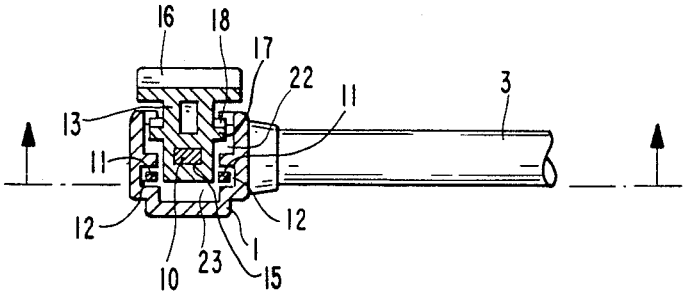
FIG. 4
FIG. 5
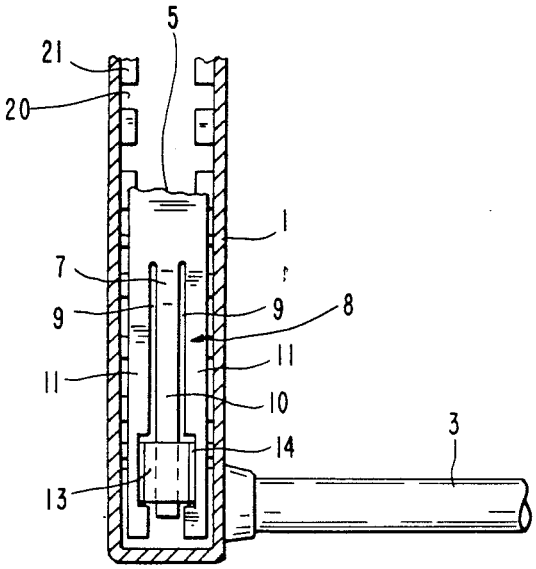

DRYING RACK

BACKGROUND OF THE INVENTION

The present invention relates to a dryer for laundry or the like, and more particularly to a drying rack adapted to be clamped onto a stationary object, such as a radiator, balcony railing, door, window frame or the like.

A known drying rack, shown in Swiss CH-A-556 936, for the hanging up of laundry, comprises adjustable clamping members which are mounted in carriers between which the elongated clothes hanging elements are arranged. The end sections of the clamping members are provided with a thread, which works operatively with a threaded mounting screw member. The disadvantage of this design is that the threaded parts, and in particular the threaded screw member, has to be very long in order to permit the mounting of the laundry hanging appliance on different fixtures having different thicknesses, e.g. radiators, balcony railings, doors and window frames. The manipulation of the screw member is especially cumbersome when transferring the laundry hanging appliance from a thin plate-type mounting fixture to, for example, a thicker fixture such as a radiator, since a protracted screwing action of the mounting screw member becomes necessary.

It is therefore the object of the present invention to provide a laundry hanging appliance or drying rack, which is easy to operate, which is easily and quickly adjusted and mounted on fixtures of different thicknesses, and which is easy to manufacture.

SUMMARY OF THE INVENTION

According to the present invention, a dryer for laundry, and which is adapted to be clamped onto a stationary member such as a radiator, railing, door, window frame or the like, comprises a pair of spaced apart carrier members, having a guiding channel formed therein; hanging means coupled between the spaced apart carrier members and on which laundry or the like is to be hung; a pair of elongated adjustable clamping means coupled to the carrier members and slidably mounted in the guiding channels of the respective carrier members; the adjustable clamping means being bent at end portions thereof which are received in the guiding channels so as to form respective springy tongue members; and a manually operable catch means coupled to respective tongue members and releasably engageable in cut-outs formed in the carrier members for adjustably locking the adjustable clamping means relative to the respective carrier members.

BRIEF DESCRIPTION OF THE DRAWING

FIG. 4 is a sectional view taken along line IV—IV in FIG. 2; and

FIG. 5 is a sectional view taken along line V—V in FIG. 4.

DETAILED DESCRIPTION

Figure 1:
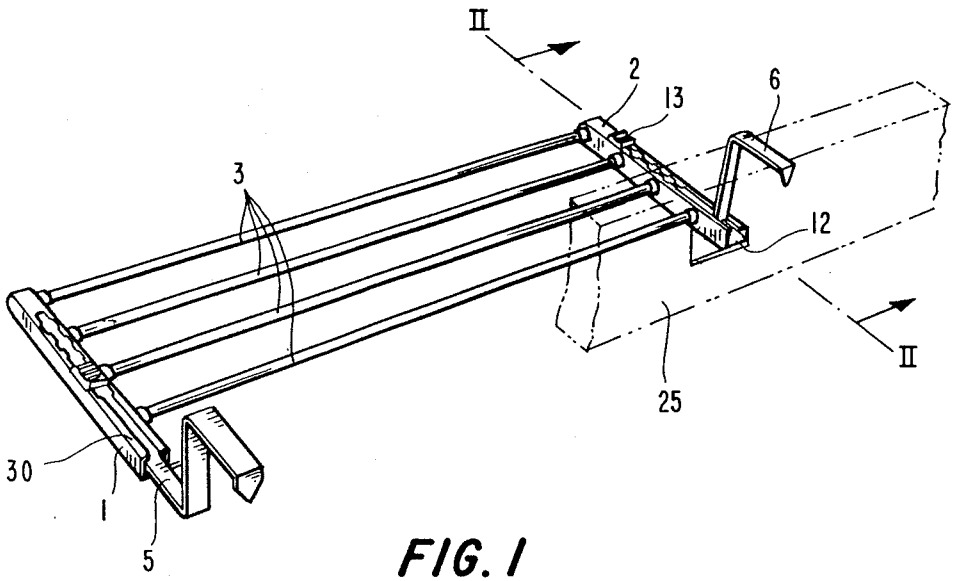
FIG. 1 is a perspective view of the drying rack for laundry or the like according to the present invention.

Referring to FIGS. 1–5, elongated channel-shaped carriers or end members 1, 2 have elongated hanging members 3 extending therebetween. The elongated hanging members 3, which in the present example are in rod-like or tubular form, are held in connecting fittings 4 (see FIG. 3) attached to each of the carriers 1. In the elongated internal channel 12 of each of the carriers 1, 2 an elongated clamping strap or bar 5 is movably (slidably) positioned. The clamping straps or bars 5 are made of sheet or bar stock, and are bent at one end to form respective hooks 6 (FIG. 2) for clamping over a support fixture 25 such as a radiator, railing, door, window frame or the like.

As shown in FIGS. 2–5, the other end portions of the clamping straps 5 or bars are slidably inserted into internal guide channels 12 of the carriers 1, 2. The end portion 8 of each of the clamping straps 5 has a pair of longitudinal slots 9 (FIG. 5) formed therein and the remaining central portion 10 (between slots 9) is bent at 7 to form a springy tongue 10 at the free end thereof. The pair of slots 9 (FIG. 5), formed on opposite sides of springy tongue part 10, extend to the ends of clamping straps 5. Therefore, the end portion or tongue region 8 comprises the central springy tongue part 10 and two lateral guiding sections 11 adjacent the central springy tongue part 10 on opposite sides of the springy tongue part 10. The clamping straps 5 are slidably carried in the guiding channel 12 of respective carriers 1, 2 so as to be slidable in the longitudinal direction thereof (i.e., in the direction of the arrow A in FIG. 2) to adjust the positions of the hook portions 6 for hanging the apparatus on a fixture.

As seen in FIGS. 2–5, a sliding catch 13 is engaged and contained in cut-outs 14 (FIG. 5) formed in the lateral guiding sections 11 of the clamping straps 5. The springy tongue part 10 is engaged and received in an internal channel 15 of sliding catch 13, as shown in FIGS. 4 and 5. Since the sliding catch 13 is engaged in cut-outs 14 of the lateral guiding sections 11 of a respective clamping strap 5, the sliding catch 13 moves together with the respective straps 5 when they are moved relative to the carriers 1, 2. In addition, the sliding catch 13 has also a sliding top key or manually operable member 16 and intermediate guide rails 17, with projections 18 formed on them (see FIG. 2.) The projections 18, which are provided with an inclined or slanted surface 19 on one side, engage in cut-outs 20 (FIG. 3) which are formed in the top side surfaces 21 of the channel-shaped carriers 1, 2 (see FIG. 3). The guiding channel 12 of carriers 1, 2 is also provided with a recessed groove 23 (FIG. 4) in the lower surface thereof in order to permit downward movement of catch 13 and springy tongue part 10 when the catch 13 is manually depressed, to thereby permit disengagement of the projections 18 of the catch !3 from the cut-outs 20 against the spring biasing force of the springy tongue part 10, to permit sliding movement of the catches 13 and clamping straps 5 relative to the carriers 1, 2, in the direction of arrow A in FIG. 2, to permit easy and quick adjustment clamping of the hook portions 6 over a mounting fixture of substantially any thickness to facilitate mounting of the apparatus to the fixture.

Figure 2:
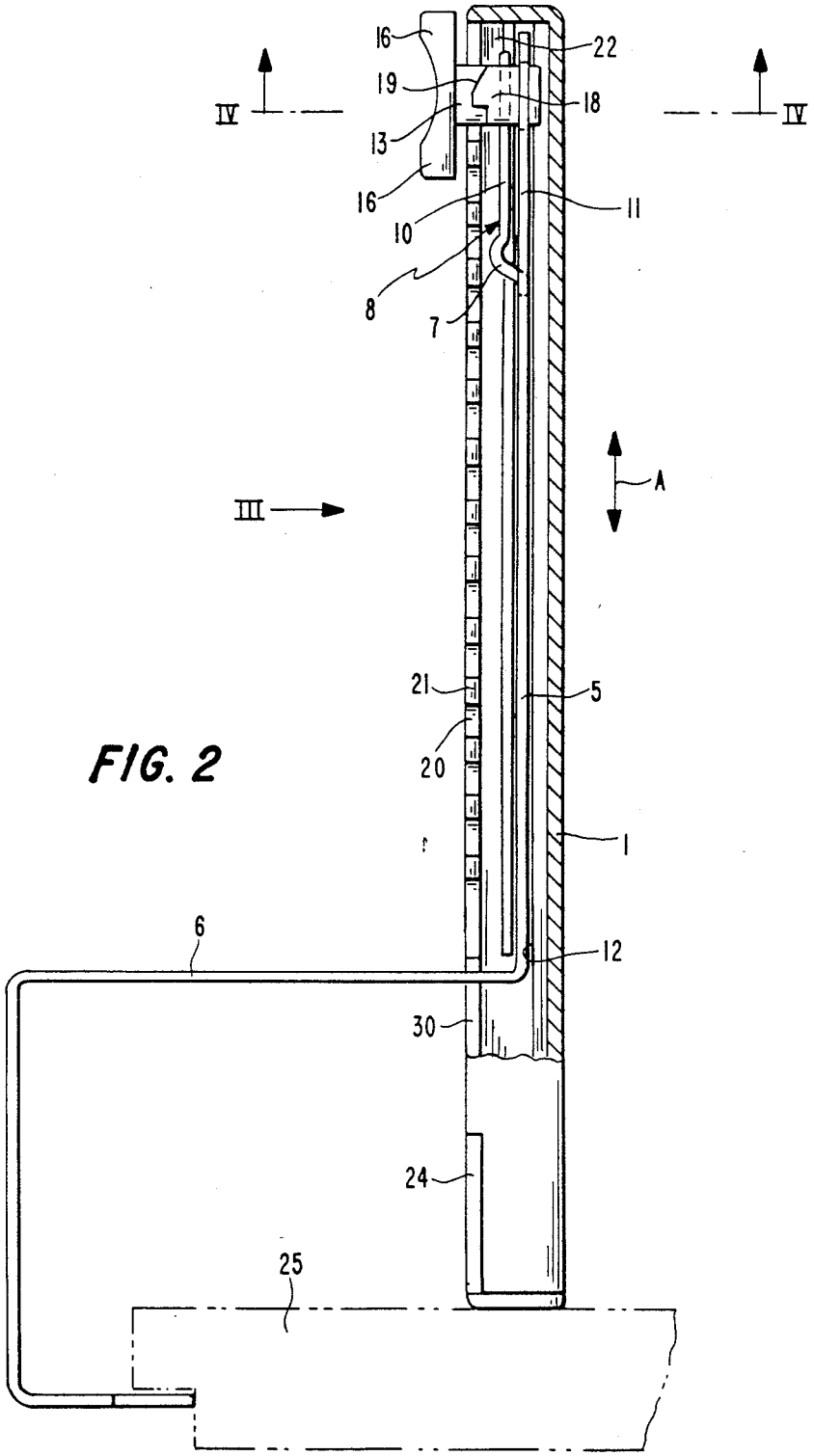
FIG. 2 is a sectional view taken along line II—II in FIG. 1.
Figure 3:
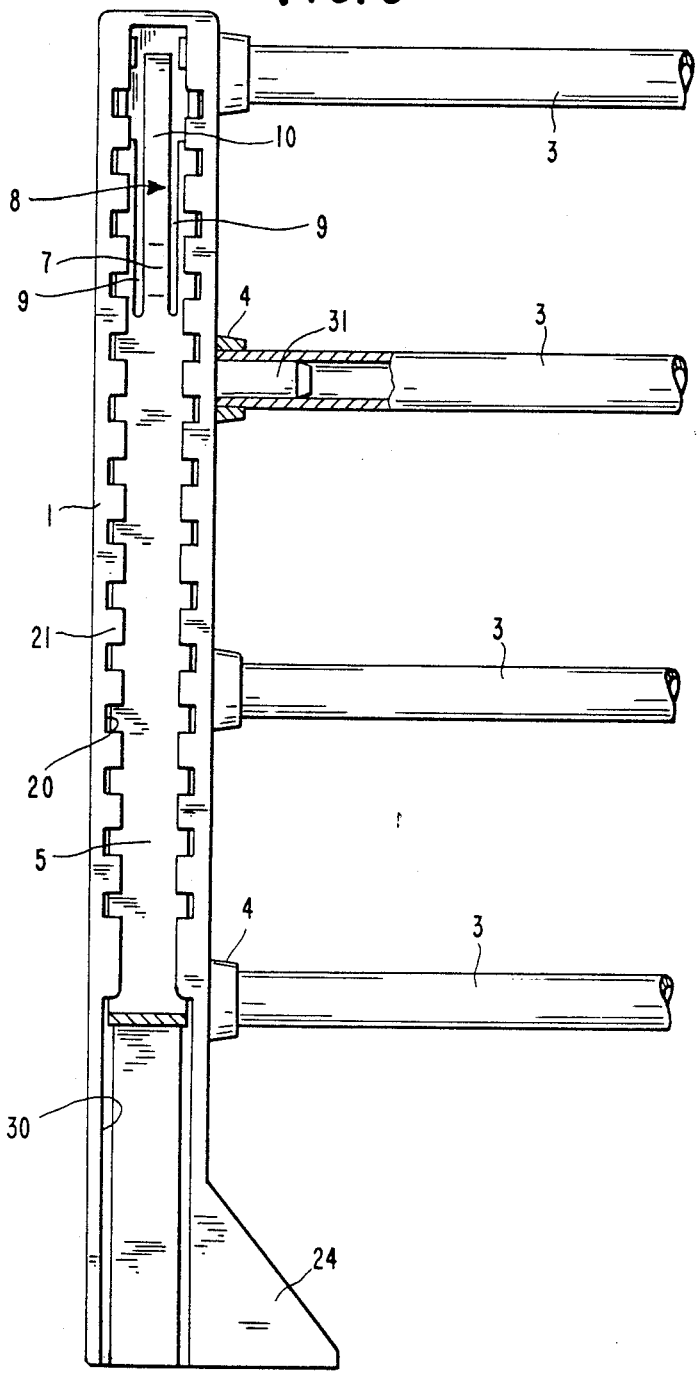
FIG. 3 is a view as seen in the direction of arrow III in FIG. 2.

As shown in FIGS. 2 and 3, on their attaching ends, the carriers 1, 2 preferably have increased-size end support or bearing portions 24 to provide for an improved attachment to the retaining components or fixture 25 (FIG. 2), such as a radiator or door. Still further, as shown in FIG. 2, the hook portion 6 of the clamping straps project upwardly from the respective carriers 1, 2 short of the ends of the carriers, that is, at an intermediate portion of the carriers. This means that the overhanging portion of the carriers (that is, the portion in the vicinity of bearing portions 24) bear up against the mounting fixture 25, and the hook portion 6 as a leg which extends a sufficient distance from the mounting fixture 25 so as to provide improved mounting leverage, to improve the support characteristics of the appliance of the present invention. Since the end slot 30 of the carriers 1, 2 is open from an intermediate portion of the carrier to the end portion thereof, the amount of overhang of the carrier relative to the vertical portion of the clamping bar is adjustable, depending upon usage.

As seen in FIG. 3, the end portions of the tubular transverse members 3 preferably have an insert 31 (or dowel) therein to reinforce end portions which are inserted into connecting fittings 4. The ends of the tubular members 3 may be press-fit in the connecting fittings 4, or may be adhered thereto by means of an adhesive or the like.

While the invention has been described above with respect to a specific embodiment, it should be clear that various modifications and alterations can be made within the scope of the invention and defined in the appended claims.

What is claimed is:

1. A dryer for laundry, which is adapted to be clamped onto a stationary member such as a radiator, railing, door, window frame or the like, comprising:

a pair of spaced apart carrier members, said carrier members each having an internal elongated guiding channel formed therein;

hanging means coupled between said spaced apart carrier members and adapted to receive laundry or the like thereon;

a pair of elongated adjustable clamping members respectively coupled to said carrier members and slidably mounted in said guiding channel of said respective carrier members, said clamping members each having mounting means at an end thereof for mounting the appliance to a stationary member;

said adjustable clamping members each having a bent portion at the end thereof which is opposite to said mounting means, and which is received in said guiding channel, said bent portion comprising a springy tongue means;

an elongated open slot formed in a portion of each of said carrier members and extending along a given portion of said elongated guiding channel of the respective carrier member, said slot opening to and communicating with said elongated guiding channel;

a plurality of cut-outs formed in at least one surface of each of said carrier members which defines a surface of said slot;

a manually operable slidable catch means coupled to each of said springy tongue means and slidably mounted in said open slot of the respective carrier means in which said clamping member is received, and said catch means being releasably engageable in said cut-outs formed in said respective carrier members so as to be selectively slidable throughout the length of said slot, relative to said carrier members, together with said respective clamping member, for adjustably locking said clamping members relative to said carrier members when said catch means is engaged in a cut-out; and said springy tongue means biasing said respective catch means toward said cut-outs and said catch means being manually operable to be moved out of engagement with said cut-outs against said biasing force.

2. The dryer of claim 1, wherein said clamping members are substantially flat, and wherein said portion in said guiding channel has a pair of end slots therein, said tongue means being formed substantially centrally between said end slots, said end slots defining respective adjacent outer guiding sections which are slidably arranged in a respective first guiding channel portion of said carrier member.

3. The dryer of claim 2, wherein said catch means comprises a sliding catch mounted on said tongue means.

4. The dryer of claim 1, wherein said catch means comprises a sliding catch mounted on said tongue means.

5. The dryer of claim 2, wherein said slidable catch means comprises a keyed sliding part; and guide rails extending from said keyed sliding part; said guide rails having projections thereon; said guide rails being slidably mounted in a second elongated guiding channel portion of said carrier members, and being engageable with said cut-outs of said carrier members.

6. The dryer of claim 5, wherein said second guiding channel portion has a dimension transverse to the length thereof which is equal to or greater than the dimension of said projections of said catch means in said same transverse direction plus the dimension of said guide rail.

7. The dryer of claim 6, wherein:

said first guiding channel portion for receiving said tongue part is separated from said second guiding channel portion; and said carrier members further comprise a groove in a lower surface of said guiding channel and having a depth corresponding to the spring travel of said tongue part when depressed by operation of said catch means.

8. The dryer of claim 7, wherein said outer guiding sections of said clamping members have cut-outs for receiving and anchoring said catch means relative to said clamping members.

9. The dryer of claim 2, wherein said outer guiding sections of said clamping members have cut-outs for receiving and anchoring said catch means relative to said clamping members.

10. The dryer of claim 1, wherein said mounting means comprises a hook portion formed by bending said clamping members.

* * * * *